US007559767B2

(12) United States Patent
Coleman et al.

(10) Patent No.: US 7,559,767 B2
(45) Date of Patent: Jul. 14, 2009

(54) HIGH-FREQUENCY DRUM-STYLE SLIP-RING MODULES

(75) Inventors: Donnie S. Coleman, Dublin, VA (US); Jack T. Galyean, Cedar Rapids, IA (US)

(73) Assignee: Moog Inc., East Aurora, NY (US)

( * ) Notice: Subject to any disclaimer, the term of this patent is extended or adjusted under 35 U.S.C. 154(b) by 129 days.

(21) Appl. No.: 11/803,483

(22) Filed: May 15, 2007

(65) Prior Publication Data

US 2008/0284584 A1 Nov. 20, 2008

(51) Int. Cl.
*H01R 39/00* (2006.01)

(52) U.S. Cl. ..... 439/13; 439/23; 439/24; 439/25

(58) Field of Classification Search ..... 439/13, 439/23–25
See application file for complete search history.

(56) References Cited

U.S. PATENT DOCUMENTS 3,405,373 A * 10/1968 Wendolkowski ..... 333/159
5,923,114 A * 7/1999 Senni ..... 310/232
6,767,217 B2 * 7/2004 Jacobson ..... 439/24
2004/0067662 A1 * 4/2004 Tsutsumi et al. ..... 439/17

* cited by examiner

*Primary Examiner*—Tho D Ta
(74) *Attorney, Agent, or Firm*—Phillips Lytle LLP

(57) ABSTRACT

A drum-style slip-ring module (100) is used in a contact-type communication system. The module utilizes PCB construction to construct a plurality of stacked electrically-conductive rings (102) and a plurality of dielectric layers (104) electrically isolating the conductive rings. Each of the dielectric layers includes a centrally-located aperture (107). The module also includes a cylindrical ground plane (108) positioned in the centrally-located aperture. The module is configured to provide electrical connection to each of the rings at an exterior surface of the module. Each group of feed line vias can be designed as impedance-controlled transmission lines with connections to each ring group. The construction described in this invention can create slip-ring transmission line structures with bandwidth from DC to 5 GHz or higher, allowing the slip-ring to be used to transfer multi-gigabit digital data streams.

4 Claims, 2 Drawing Sheets

HIGH-FREQUENCY DRUM-STYLE SLIP-RING MODULES

TECHNICAL FIELD

The present invention relates generally to electrical slip-rings, and, more particulary, to improved drum-style slip-ring modules capable of transmitting high-frequency signals.

BACKGROUND ART

Contact-type slip-rings have been widely used to transmit signals between two members (e.g., a rotor and a stator) that move rotationally relative to one another. Prior art slip-rings of this nature have utilized stator-mounted conductive probes formed of a precious-metal alloy to make contact with a rotating ring. These probes, or sliding contacts, have traditionally been constructed using round-wire, composite materials, button contacts, or multi-filament fiber brushes. The cooperative concentric contact rings of the slip-ring are typically formed to provide a cross-sectional shape appropriate for the probes or sliding contacts. Typical ring shapes have included V-grooves, U-grooves and flat rings. Similar schemes have been used with systems that exhibit relative translational motion, rather than relative rotary motion, and that implement drum-style slip-rings.

When transmitting high-frequency signals through slip-rings, a major factor limiting the transmission rate is distortion of the waveforms due to reflections from impedance discontinuities. Impedance discontinuities can occur throughout the slip-ring wherever different forms of transmission lines interconnect and have different surge impedances. Significant impedance mismatches often occur where transmission lines interconnect a slip-ring to an external interface, at the brush contact structures, and where the transmission lines connect those brush contact structures to their external interfaces. Severe distortion of high-frequency signals can occur from any of these impedance-mismatched transitions of the transmission lines, compounding the distortion with each mismatched interface. Further, severe distortion can also occur due to phasing errors from multiple parallel brush connections and the multipath effects inherent in slip-rings.

The loss of energy through slip-rings increases with frequency due to a variety of effects beyond the normal dielectric and skin effect loses of transmission lines. These effects include circuit resonance, multiple reflections from impedance mismatches, and parasitic inductive and capacitive reactance. These losses are among the key factors that limit high-frequency performance in transmission lines in general, and slip-rings in particular. Because these factors are acute with contact-type slip-rings, other techniques have been explored. High-frequency analog and digital communication across rotary interfaces has also been achieved or proposed by other techniques, such as fiber optic interfaces, capacitive coupling, inductive coupling, and direct transmission of electromagnetic radiation across an intervening space. However, systems employing these techniques tend to be relatively expensive.

What is needed is a contact-type slip-ring module for a slip-ring system that generally addresses the above-referenced problems, while providing a readily producible and economical slip-ring system.

DISCLOSURE OF THE INVENTION

The present invention is generally directed to a drum-style slip-ring module that is used in a contact-type communication system. In particular, the techniques of this invention allow for extended high-frequency performance in a drum-style slip-ring, due to the construction of impedance-controlled transmission lines throughout the structures. Printed circuit board technologies offer a novel approach to implementing high-frequency drum-style slip-rings, with significant advantages over conventional techniques. Details of the PCB construction technique are given below, followed by a description of a more conventional stacked-ring approach that utilizes some of the techniques necessary to produce a high frequency slip-ring.

The improved slip-ring module includes a plurality of stacked electrically-conductive rings, and a plurality of alternating intermediate dielectric layers positioned between and electrically isolating the conductive rings. The drum-style slip-ring can be implemented with multi-layer printed circuit board technology that can produce PC boards on the order of one centimeter in thickness. Each of the dielectric layers includes provisions for the construction of internal transmission line feed structures, including a cylindrical ground plane positioned in the centrally-located aperture, coaxial with the ring system. The module is configured to provide electrical connection at an exterior surface to the internal transmission lines of the slip-ring.

Conductive rings are produced by metal PCB layers incorporating grooves for receiving a sliding contact from a brush block transmission line structure. Feed connections to the ring structures are implemented by means of conductive via structures arranged to create controlled-impedance transmission lines. Such a slip-ring constructed according to the present invention will have an operational bandwidth of several gigahertz, with resonance appearing as high as five gigahertz in relatively small constructions. Although the slip-ring module may be of any desired size, high frequency performance is enhanced by physically-small units, with diameters of less than two centimeters.

Internal feed line structures are arranged to support single-ended or differential transmission modes, allowing impedance-controlled interfaces to external transmission lines, such as flex or rigid PCB's, as well as conventional wire transmission lines. Multiple feed points to the rings extend the high-frequency response of the slip-ring. Crosstalk among the slip-ring channels is controlled by means of the central ground plane, grounded metal layers incorporated between ring groups, and between feed line structures within the slip-ring.

With parenthetical reference to the corresponding parts, portions or surfaces of a disclosed embodiment, merely for purposes of illustration and not by way of limitation, the present invention provides, in one aspect, an improved drum-style slip-ring module 100, that broadly includes: a plurality of stacked electrically-conductive rings (102); a plurality of dielectric layers (104) electrically isolating the conductive rings, wherein each of the dielectric layers includes a centrally-located aperture (107); and a cylindrical ground plane (108) positioned in the centrally-located aperture, wherein the module is configured to provide electrical connection to each of the rings at an exterior surface of the module.

The improved module of any size may be constructed using printed circuit board (PCB) techniques. The slip-ring may be optimized for high-frequency performance, having operational bandwidths of several gigahertz. The improved module may be constructed to have a diameter of any size. Each of the rings may be coupled to a buried feed line that is coupled to the exterior surface of the module by a feed line via for connection to an external device. The rings may be grouped into a first ring group and a second ring group, each including at least two of the rings, and the module may further include a shield layer coupled between the first ring group and the second ring group, wherein the shield layer is electrically coupled to the cylindrical ground plane.

In another aspect, the invention provides an improved drum-style slip-ring module (200) that broadly includes: a plurality of stacked electrically-conductive rings (202); a plurality of dielectric layers (204) electrically isolating the conductive rings, wherein each of the dielectric layers includes a centrally-located aperture (207); and a cylindrical ground plane (208) positioned in the centrally-located aperture, wherein the module is configured to provide electrical connection to each of the rings at an exterior surface of the module, and wherein the slip-ring module is constructed using printed circuit board (PCB) techniques.

The improved slip-ring module may be constructed using individually-stacked rings and insulators. Each of the rings may be coupled to a buried feed line that is coupled to the exterior surface of the module by a via transmission line structure for connection to an external device.

In yet another aspect, the invention provides an improved drum-style slip-ring module (200) that broadly includes: plurality of stacked and vertically-spaced electrically-conductive rings (202); a plurality of intermediate dielectric layers (204) positioned between and electrically isolating the conductive rings, wherein each of the dielectric layers includes a centrally-located aperture (207); a cylindrical ground plane (208) positioned in the centrally-located aperture, wherein the module is configured to provide electrical connection to each of the rings at an exterior surface of the module; and at least one shield layer (212) positioned between two of the rings and electrically coupled to the cylindrical ground plane.

These and other features, advantages and objects of the present invention will be further understood and appreciated by those skilled in the art by reference to the following specification, claims and appended drawings.

DESCRIPTION OF THE PREFERED EMBODIMENTS

Figure 1:
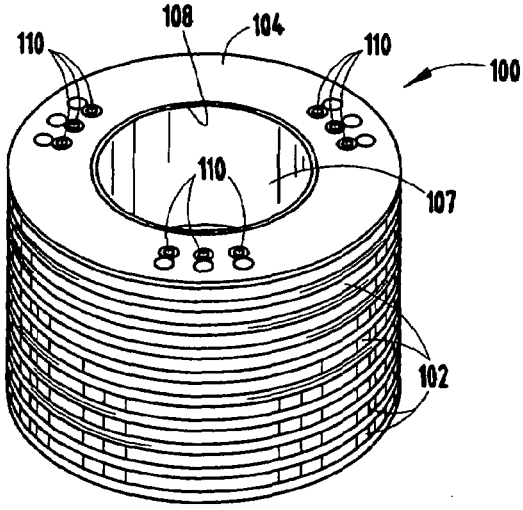
FIG. 1 is a perspective view of a drum-style slip-ring module including nine conductive rings and three transmission line structures.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

According to various embodiments of the present invention, an improved high-frequency drum-style slip-ring module can be manufactured using novel printed circuit board (PCB) construction techniques. High-frequency operation of the slip-ring module is enhanced due to the relatively-small size of the drum-style slip-ring module and the PCB construction, which readily facilitates implementation of controlled-impedance transmission line structures. The drum-style slip-ring modules may be constructed using PCB technology with very thick (e.g., ten ounce) copper sheets and intermediate bonding plies. The PCB stack can be readily built-up to thicknesses greater than one centimeter, to provide a plurality of drum-style slip-ring modules on a single panel. The modules can then be cut from the panel and the rings may be machined to provide a smooth cylindrical outer surface. The thick copper rings at an exterior edge of the slip-ring module may then be grooved through a machining process, etc. The grooves may then be plated with a precious metal, as desired, using a removable bussing system of various configurations for a common electrical connection to the plated ring grooves.

In general, connection to the rings is facilitated by a transmission line structure that includes a plated-through via that is configured in a desired physical arrangement so as to provide a desired impedance-controlled transmission line. In a typical application, feed line connections are made through one end of a feed line via structure, and termination resistors are applied across an opposite end of the feed line via structure, with a connection to an appropriate one of the rings occurring along the intermediate length of the feed line via. In an exemplary drum-style slip-ring module, nine active rings may be implemented (e.g., configured as three clusters of three or four rings for use with a shielded twisted pair or dual coaxial transmission line). The feed line vias are typically routed through the entire thickness of the slip-ring PCB and exit at opposite surfaces, although it is also possible to implement blind via construction. As mentioned above, pads may be implemented to facilitate attachment of surface mount or embedded resistive terminations. It should be appreciated that the rings of the slip-ring module may be fed in a number ways, ranging from a single-point connection to multi-point connections. Typically, the number of feed points is selected as a function of bandwidth and impedance.

It should also be appreciated that a drum-style slip-ring module, configured according to the present invention, may be constructed by a number of different processes. In general, when the conductive rings are to be relatively thick (e.g., ten-ounce) copper, bonding sheet flow capability should be considered in order to properly fill the copper cavities. Dielectric constant and loss-tangent electrical properties of the materials utilized in a drum-style slip-ring module should also be considered in order to provide a desired bandwidth at higher signal speeds (e.g., 1 GHz and above). Typically, materials should be selected with consideration of adhesion properties of the bonding sheets to the copper and the core material surfaces. Further, plating adhesion properties to pure resin areas of plated hole walls should also be considered. Additionally, materials may also be selected for ease of machining on a lathe. Z-axis expansion, which affects plated-through hole reliability for end product thermal and mechanical requirements, should also be considered when selecting materials for the slip-ring module.

The implemented bonding system should generally provide flow parameters above normal industry flow and fill requirements. Factors that increase flow must be identified for any material type used. Typically, material flow parameters are affected predominantly by heat rise, lamination pressure and bonding sheet glass-weave style, with associated initial epoxy resin content. Increased heat rise, in combination with other factors, typically increases the ability of a bonding sheet to fill thick copper cavities, such as etched 10-ounce copper. Lamination pressure can also effect epoxy flow and fill capabilities. Furthermore, bonding sheets with higher typical resin content may also be utilized to increase flow and fill.

Dielectric constant and loss tangent may significantly affect the bandwidth, particularly at frequencies above 1 GHz. In general, materials for a module should be selected based upon structural reliability and high-speed signal performance.

According to the present invention, slip-rings having a thickness between about 0.280 inches and 0.480 inches, with a final hole size plating aspect ratio of up to 14 to 1 may be readily manufactured.

Figure 1A:
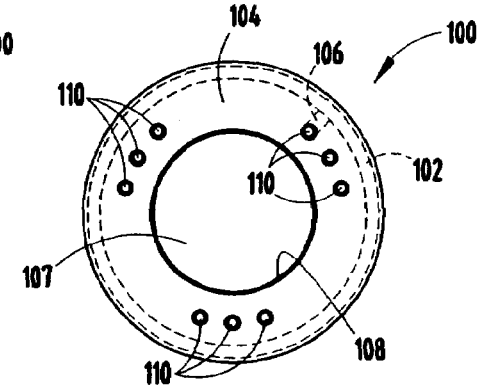
FIG. 1A is a bottom plan view of the module of FIG. 1.

With reference to FIGS. 1 and 1A, a drum-style slip-ring module 100 is depicted as including a plurality of rings, severally indicated at 102, separated by a plurality of intermediate dielectric layers 104, which electrically isolate the conductive rings 102. As is shown through the top dielectric layer 104 in FIG. 1A, the module 100 includes a plurality of buried feed lines 106, which are coupled to a different one of a plurality of feed line vias 110, which extend from one surface of the module 100 to an opposite surface of the module 100. The module 100 also includes a central ground plane via 108, which is centrally positioned in an aperture 107 that is provided through the rings 102 and dielectric layers 104. In a typical application, an exterior edge of each of the conductive rings 102 includes a groove for receiving a contact of a brush block. Using the processes set forth herein, a module with a thickness greater than about one centimeter may be constructed. In one application, the thickness of the conductive rings 102 is selected to be about 15 mils (e.g., 10 ounce/sq ft copper density). It should be appreciated that a slip-ring module may be constructed with conductive rings having a thickness greater than or less than that of 10-ounce copper.

Figure 2:
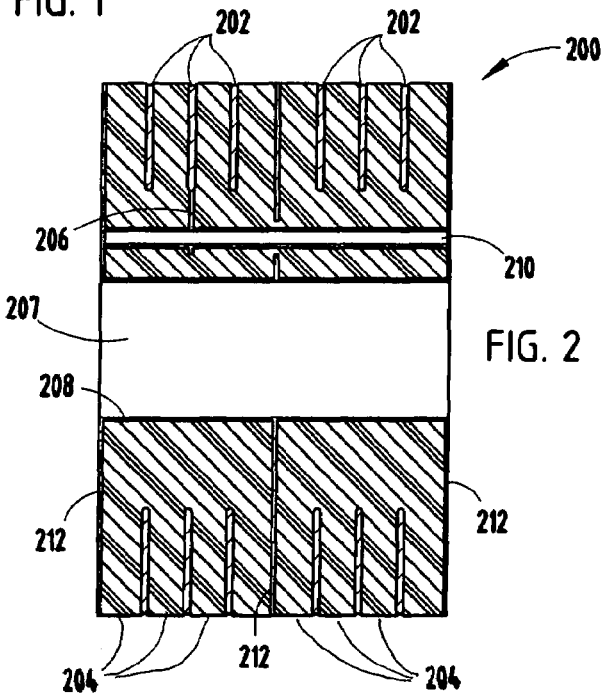
FIG. 2 is an axial cross-sectional view of a drum-style slip-ring module having six conductive rings and one shield layer.

FIG. 2 depicts a drum-style slip-ring module 200 having six conductive rings 202, with associated feed lines 206, and three shield layers 212. The rings 202 are electrically isolated from each other and from a central via ground plane 208 by dielectric layers 204. As is depicted, the shield layers 212 are connected to a central via ground plane 208, which is positioned in aperture 207.

Figure 3:
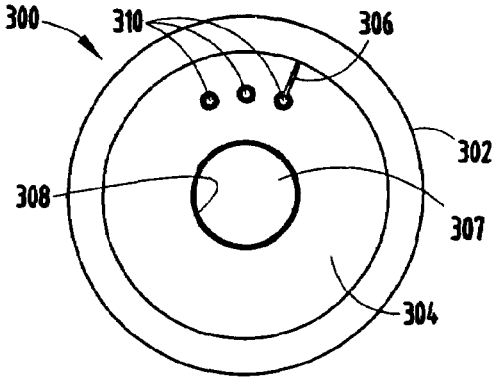
FIG. 3 is a top plan view of a drum-style slip-ring module that illustrates a single feed point connection to one conductive ring.

With reference to FIG. 3, a relevant portion of a drum-style slip-ring module 300, including single point feed lines 306, is depicted. As is shown, dielectric layers 304 electrically isolate a central via ground plane 308 from rings 302. Each of the rings 302 is connected to a different feed line via 310 by a different one of the single point feed lines 306.

Figure 4:
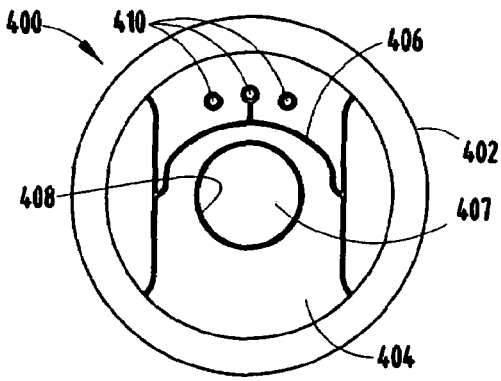
FIG. 4 is a top plan view of a drum-style slip-ring module that implements quadrature feed to a conductive ring.

Turning to FIG. 4, a drum-style slip-ring module 400 is depicted that is similar to the module 300 of FIG. 3, with the exception that the module 400 includes rings 402 having quadrature feed lines 406 that couple each of the rings 402 to one of a plurality of feed line vias 410. Similar to the module 300, the module 400 includes dielectric layers 404 that electrically isolate rings 402 from each other and from the central via ground plane 408 (positioned in aperture 407).

Figure 5:
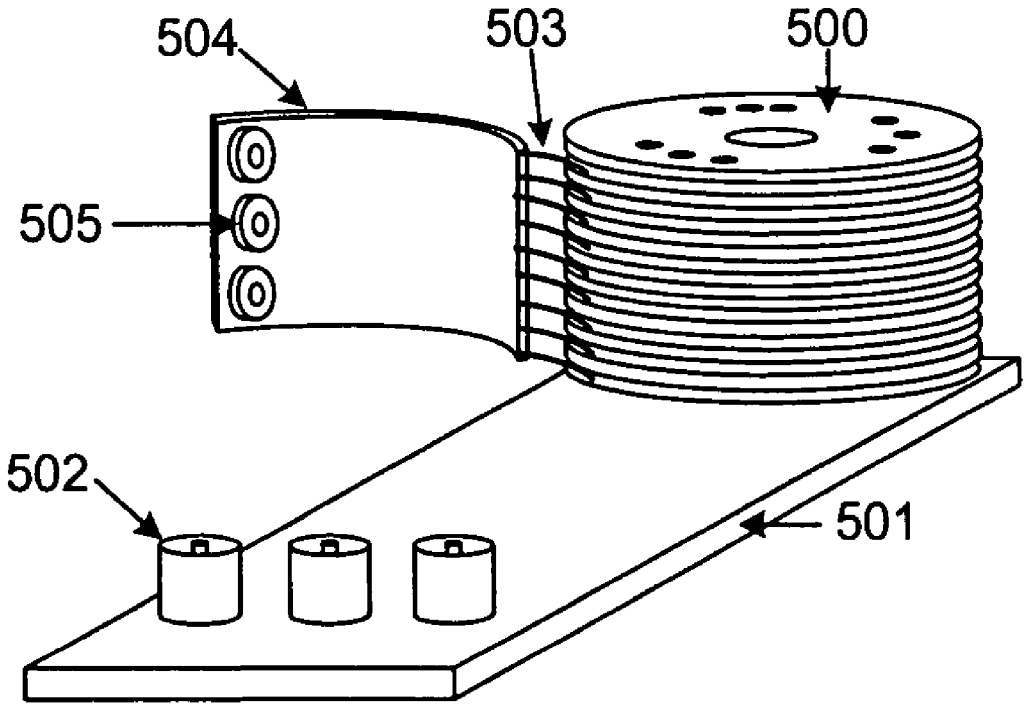
FIG. 5 is a perspective view illustrating one embodiment of a complete slip-ring assembly, showing rigid and flexible impedance-controlled transmission line structures, with electrical connectors.

Accordingly, a drum-style slip-ring module and a process for manufacturing the module has been described herein, which provides a relatively-small module that is capable of operating at frequencies to beyond 5 GHz. Transmission feed line structures for input and output connections to the high frequency slip-ring module complete the assembly to create a cost effective and manufacturable design. FIG. 5 illustrates one such embodiment, with external feed lines implemented with impedance-controlled printed circuit techniques utilizing rigid and flexible substrates to produce a multi-channel high frequency slip-ring module. In FIG. 5, slip-ring module 500 is mounted to a rigid PC board 501 along with electrical connectors 502, with impedance-controlled transmission lines interconnecting the slip-ring module and the connectors. The sliding electrical contacts 503 are mounted to a flexible transmission line 504 that also mounts the electrical connectors 505, again with interconnections by means of impedance-controlled transmission lines.

The high-frequency slip-ring module can be implemented using more conventional stacked-ring techniques, with some of the advantages of the PCB technique by incorporating a central metallic ground plane cylinder and providing impedance-controlled transmission line connections to the rings, including geometries similar to those shown in the drawing figures illustrating the PCB technique.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A drum-style slip-ring module, comprising:

a plurality of stacked electrically-conductive rings;

a plurality of dielectric layers electrically isolating the conductive rings, wherein each of the dielectric layers includes a centrally-located aperture; and a cylindrical ground plane positioned in the centrally-located aperture, wherein the module is configured to provide electrical connector to each of the rings at an exterior surface of the module, wherein each of the rings is coupled to a buried feed line that is coupled to the exterior surface of the module by a feed line via for connection to an external device, and wherein the rings are grouped into a first ring group and a second ring group each including at least two of the rings, and wherein the module further comprises:

a shield layer coupled between the first ring group and the second ring group, wherein the shield layer is electrically coupled to the cylindrical ground plane.

2. The module of claim 1, wherein the module is constructed using printed circuit board (PCB) techniques.

3. The module of claim 1, wherein the slip-ring is optimized for high-frequency performance, having operational bandwidths of several gigahertz.

4. The module of claim 1, wherein a diameter of the module can be any arbitrary size.

* * * * *